US007971323B2

(12) United States Patent
Li

(10) Patent No.: US 7,971,323 B2
(45) Date of Patent: Jul. 5, 2011

(54) CLIP STRUCTURE FOR WIRELESS TRANSMISSION DEVICES

(75) Inventor: Ray-Jong Li, Taipei (TW)

(73) Assignee: Tatung Company, Taipei (TW)

( * ) Notice: Subject to any disclaimer, the term of this patent is extended or adjusted under 35 U.S.C. 154(b) by 263 days.

(21) Appl. No.: 12/314,098

(22) Filed: Dec. 4, 2008

(65) Prior Publication Data

US 2009/0255097 A1 Oct. 15, 2009

(30) Foreign Application Priority Data

Apr. 15, 2008 (TW) ..... 97113569 A

(51) Int. Cl.
*A44B 21/00* (2006.01)

(52) U.S. Cl. ..... 24/3.12; 224/666; 224/930

(58) Field of Classification Search ..... 224/163, 224/904, 197, 666, 667, 269, 930; 24/3.12, 24/3.11, 459, 457
See application file for complete search history.

(56) References Cited

U.S. PATENT DOCUMENTS 780,962 A * 1/1905 Perry ..... 24/3.11
4,821,934 A * 4/1989 Alessi et al. ..... 224/667
5,016,326 A * 5/1991 Goldenberg ..... 24/3.11
6,283,348 B1 * 9/2001 Wang ..... 224/271
6,513,201 B2 * 2/2003 Beune et al. ..... 24/3.2
6,691,374 B2 * 2/2004 Coyne ..... 24/3.3
6,752,299 B2 * 6/2004 Shetler et al. ..... 224/197
6,915,900 B2 * 7/2005 Chen ..... 206/350
6,981,623 B2 * 1/2006 Iitsuka ..... 224/197
7,770,727 B2 * 8/2010 Meng ..... 206/373
2002/0139822 A1 * 10/2002 Infanti ..... 224/197
2008/0104801 A1 * 5/2008 Yeh ..... 24/3.12

* cited by examiner

*Primary Examiner* — Robert J Sandy
*Assistant Examiner* — Rowland D Do
(74) *Attorney, Agent, or Firm* — Bacon & Thomas, PLLC

(57) ABSTRACT

A clip structure for a USB wireless transmission device includes a housing, a flexible clip, a guide ramp, and a positioning wall. The flexible clip is pivotally disposed on the housing and is provided, on a surface thereof, with the guide ramp and the positioning wall. When the flexible clip is pivoted to a clipping position, the positioning protrusion of the housing happens to fall between the guide ramp and the positioning wall, and that the positioning wall restrains the positioning protrusion therein and prevents the flexible clip from pivoting and escaping from the clipping position. Therefore, a flexible object, to be clipped, is clipped in several folds so as to obtain a desirable clipping and securing effect.

9 Claims, 4 Drawing Sheets

CLIP STRUCTURE FOR WIRELESS TRANSMISSION DEVICES

BACKGROUND OF THE INVENTION

1. Field of the Invention

The present invention relates to a clip structure, more particularly, to a pivotable clip structure adapted for a USB wireless transmission device.

2. Description of Related Art

Referring to FIG. 1, a schematic view illustrating a conventional wireless music transmission device, the wireless music transmission device mainly comprises a receiver 91 and a transmitter 92. When in use, the transmitter 92 needs to be plugged in a computer system 93, for instance, a USB port. Listeners have to employ an earphone 95 of the receiver 91 in order to receive voice signals. This may include listening to music played from the computer system 93, or to voice messages through network communication software, etc. Because the conventional wireless transmitter has a merit in having users receive the voice signals remote from the computer system 93, limitation on requiring a real transmission cord can be avoided. Therefore, the receiver 91 will be accompanied with a clip 94 for holding the receiver 91 on the users' clothing.

However, the clip 94 used in a conventional wireless transmitter generally clips on the user's clothing in a "partial surface clipping measure" or in a "linear clipping measure." The clipping measure shown in FIG. 1 relates to a "surface clipping measure." No matter any one of the two clipping measures is used, experiences tell that there is a defect of "unstable clipping." That is to say, the receiver 91 would be slipped away from the clothing easily.

As such, an improved clip structure is necessary so as to obtain a more stable clipping effect.

SUMMARY OF THE INVENTION

The present invention is to provide a clip structure for a USB wireless transmission device, comprising a housing, a flexible clip, a guide ramp, and a positioning wall. The housing is provided, on a surface thereof, with a positioning protrusion. The flexible clip is pivotally disposed on the surface of the housing, and includes an internal clip surface opposite to the surface of the housing.

The guide ramp and the positioning wall protrude from the internal clip surface. The positioning wall is disposed between a pivotal location of the flexible clip and the guide ramp. The guide ramp is sloped down toward a direction away from the positioning wall.

When the flexible clip is pivoted to a clipping position, the positioning protrusion happens to fall between the guide ramp and the positioning wall, and that the positioning wall restrains the positioning protrusion therein and prevents the flexible clip from pivoting and escaping from the clipping position. Therefore, not only the clip structure, when proceeded with a clipping action, can guide an object, to be clipped, into a clipping space without difficulties, but can also achieve a stable clipping effect, during a clipping state, that the object is clipped in several folds, equivalent to a multi-point clip.

The positioning wall may have a U-shaped configuration, with both ends formed with oblique surfaces. The housing may include a fastening concave, and that the flexible clip may include a hook, such that the flexible clip fastens to the housing by inserting the hook into and engaging with the fastening concave, and that the hook can pivot about the fastening concave. The hook may include two arc resilient arms each of which extends, at top, outwardly and is engaged with the housing.

The flexible clip may be further provided with a reinforcing rib for pressing on a wall of the fastening concave so as to provide a resistance for preventing the hook from being disengaged from the fastening concave. The positioning protrusion may have an arc tip, and that a top of the guide ramp is curved. A hole may be provided on the internal clip surface of the flexible clip, such that a string can pass through the hole.

Other objects, advantages, and novel features of the present invention will become more apparent from the following detailed description when taken in conjunction with the accompanying drawings.

DETAILED DESCRIPTION OF THE PREFERRED EMBODIMENTS

The clip structure according to the present invention can be applied to any portable device, though the following embodiment is exemplified with a USB wireless music transmission device.

Figure 1:
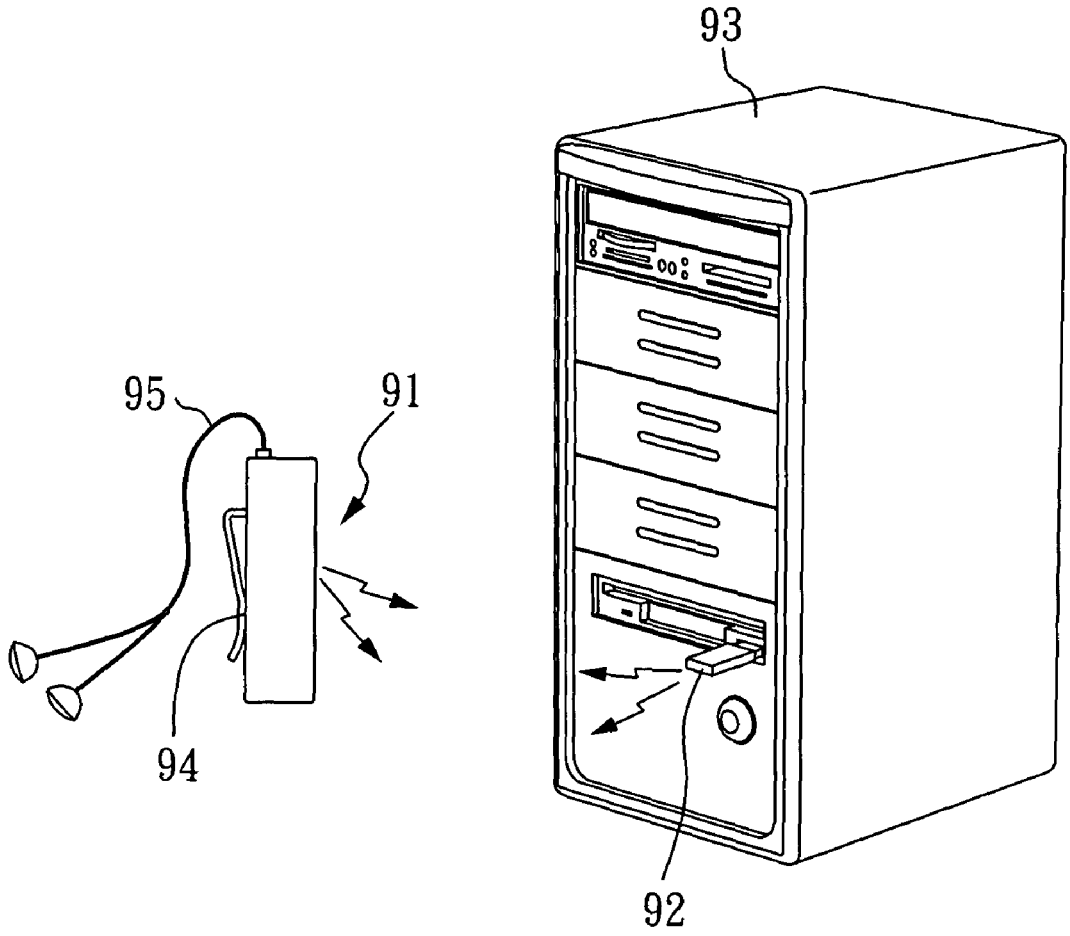
FIG. 1 (PRIOR ART)
FIG. 1 is a schematic view illustrating a conventional wireless music transmission device.
Figure 2:
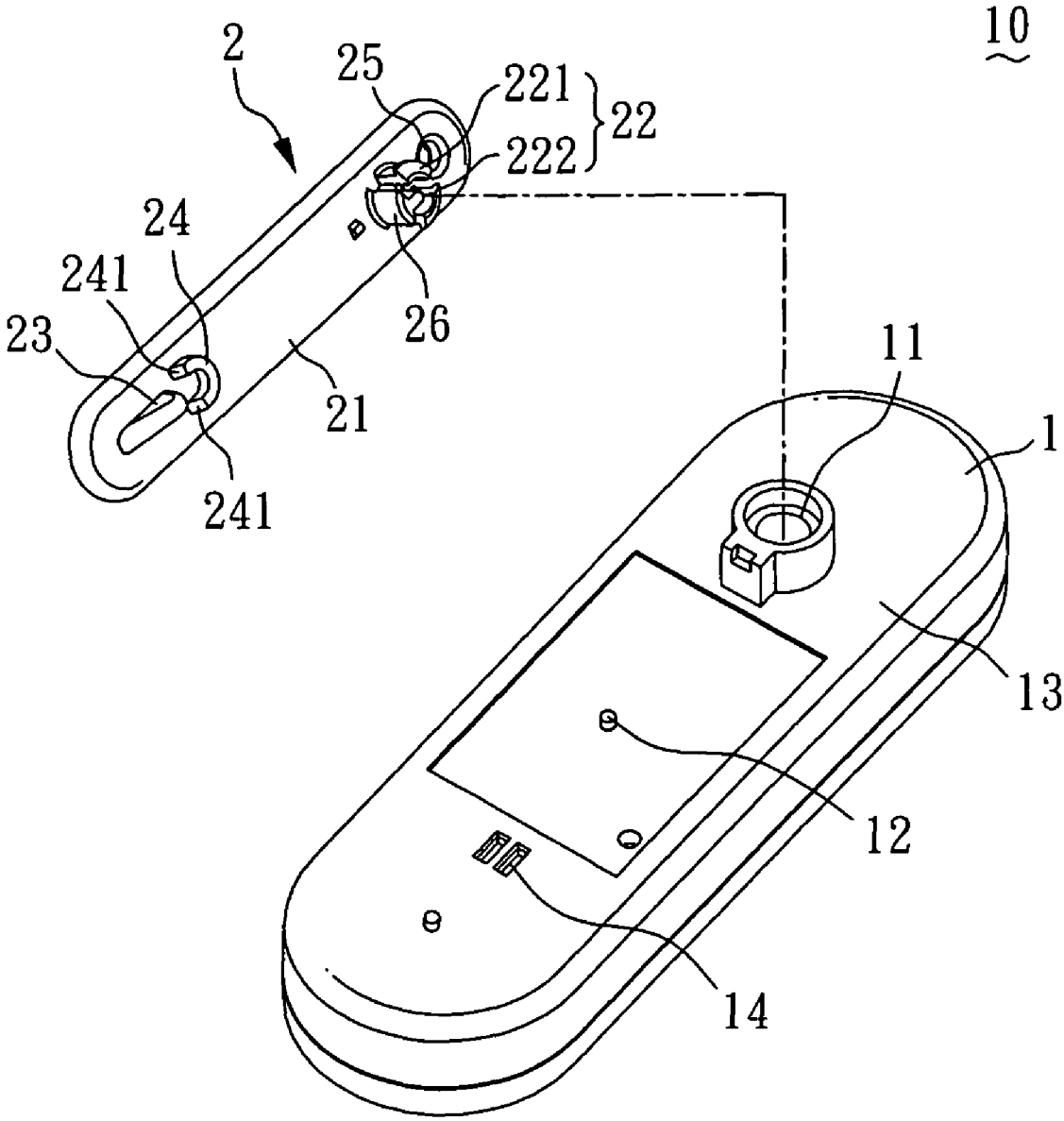
FIG. 2 is an exploded view illustrating a clip structure for a wireless transmission device according to the present invention.
Figure 3:
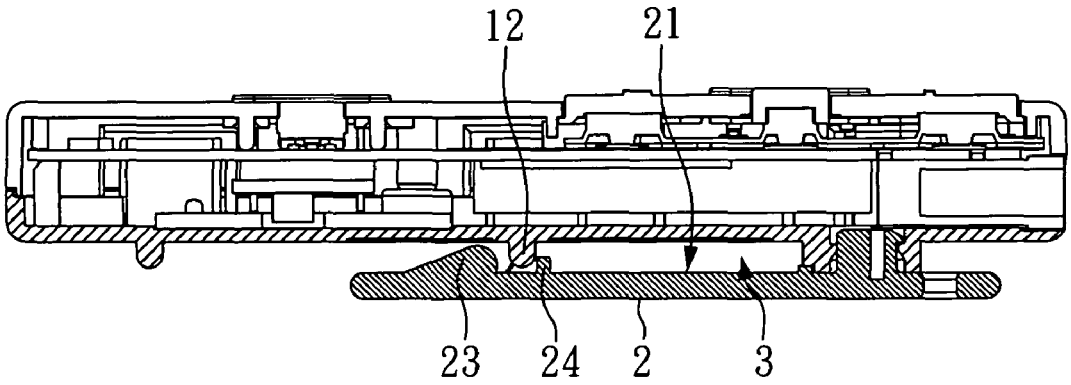
FIG. 3 is a cross-sectional view illustrating the clip structure for a wireless transmission device according to the present invention.

Referring to FIGS. 2 and 3, an exploded and a cross-sectional views illustrating a clip structure for a USB wireless transmission device according to the present invention, the USB wireless transmission device mainly comprises a receiver 10 and a transmitter 30 (shown in FIG. 5), wherein the receiver 10 includes a housing 1, a flexible clip 2, a guide ramp 23, and a positioning wall 24.

Further, the housing 1 is provided, on a surface 13 thereof, with a fastening concave 11 and a positioning protrusion 12, wherein the positioning protrusion 12 has an arc tip. The positioning protrusion 12 is provided for positioning the transmitter 30 when a contact 14 of the receiver 10 is electrically connected with the transmitter 30. An internal clip surface 21 of the flexible clip 2, opposite to the surface 13 of the housing 1, is formed with a hook 22, the guide ramp 23, and the U-shaped positioning wall 24, wherein the hook 22 is constituted by two arc resilient arms 221,222 each of which extends, at top, outwardly.

The flexible clip 2 fastens to the housing 1 in such as manner that the hook 22 of the flexible clip 2 inserts into and is engaged with fastening concave 11 of the housing 1, such that the hook 22 can pivot about the fastening concave 11. The flexible clip 2 is also provided with a reinforcing rib 26, so that when the hook 22 is engaged with the fastening concave 11, the reinforcing rib 26 presses on a wall of the fastening concave 11 so as to provide a resistance for preventing the hook 22 from being disengaged from the fastening concave 11.

The positioning wall 24 has a U-shaped opening toward the guide ramp 23, and is disposed between a pivotal location of the flexible clip 2 (i.e. a location of the hook 22) and the guide ramp 23. The guide ramp 23 is sloped down toward a direction away from the positioning wall 24, where a top of the guide ramp 23 is curved. The positioning wall 24 is, at both ends, formed with oblique surfaces 241 having a declined direction same as that of the guide ramp 23.

Upon assembling the flexible clip 2 to the housing 1, the flexible clip 2 is pivoted to a clipping position (as shown in FIG. 3), and then a partition space 3 is formed between the internal clip surface 21 of the flexible clip 2 and the surface of the housing 1. The positioning protrusion 12 happens to fall between the guide ramp 23 and the positioning wall 24, and is surrounded by the positioning wall 24. The positioning wall 24 of the flexible clip 2 will restrain the positioning protrusion 12 therein and prevent the flexible clip 2 from pivoting and escaping from the clipping position.

To facilitate carrying the USB wireless transmission device, according to the present invention, a hole 25 is provided on the internal clip surface 21 of the flexible clip 2, such that a string can pass through the hole 25 and that the wireless transmission device can be hanged on a user's neck. As such, there are two options for carrying the USB wireless transmission device.

Figure 4:
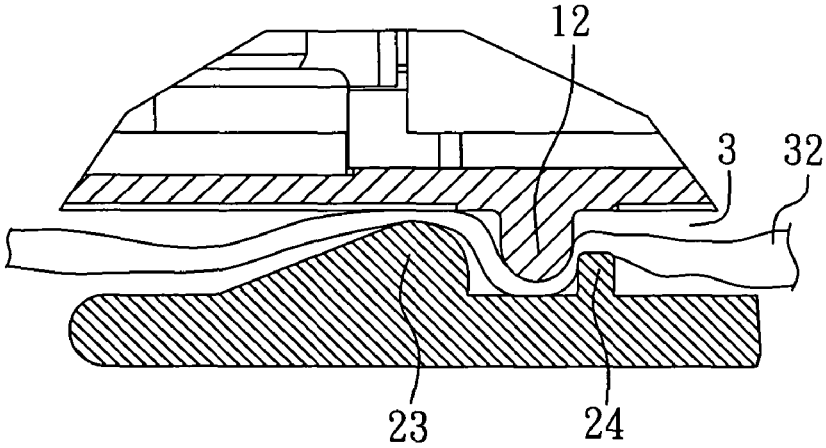
FIG. 4 is a partial cross-sectional view illustrating the clip structure in a state of use.

Referring to FIG. 4, a partial cross-sectional view illustrating the clip structure in a state of use, the flexible clip 2 is at the clipping position, where the flexible clip 2 is clipped to the user's clothing 32 starting from the guide ramp 23. Thanks to guidance of the guide ramp 23 and flexibility of the flexible clip 2, the clothing 32 can be squeezed into the partition space 3. In particular, the arc tip of the positioning protrusion 12 and the curved top of the guide ramp 23 will help the clothing 32 reach to the partition space 3.

Given the above, it is understood that through cooperation of the positioning protrusion 12, the guide ramp 23, and the positioning wall 24, the clothing 32 is clipped by the receiver 10 in several folds, equivalent to multi-point clips. Such a clipping measure can make the receiver 10 being stably secured on the clothing 32, and scarcely slipped away from the clothing 32.

Figure 5:
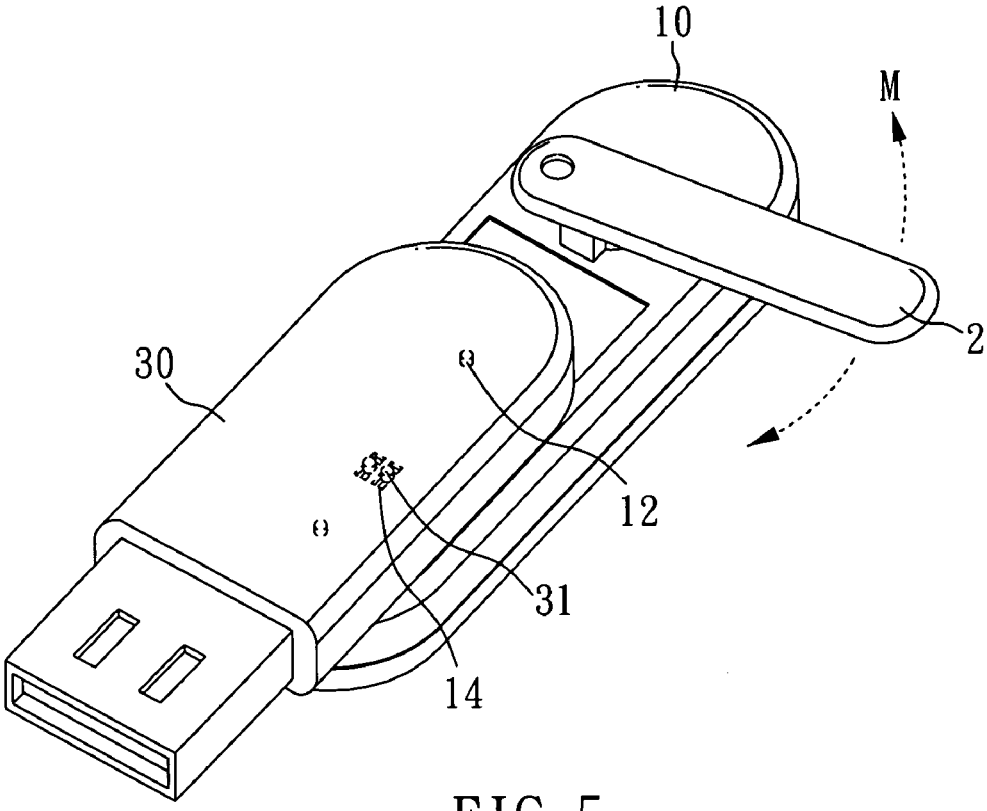
FIG. 5 is a perspective view illustrating the clip structure in a non-clipping position.
Figure 6:
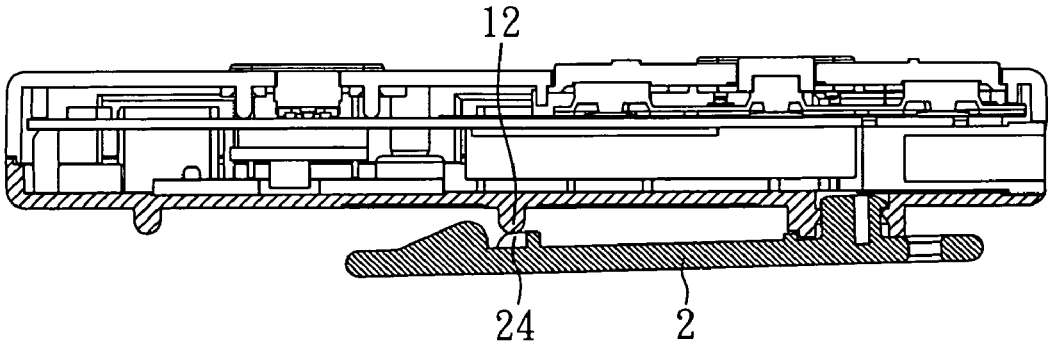
FIG. 6 is a cross-sectional view illustrating the clip structure in a transitional position between a clipping position and the non-clipping position.

Now, referring to FIG. 5, a perspective view illustrating the clip structure in a non-clipping position, and to FIG. 6, a cross-sectional view illustrating the clip structure in a transitional state between a clipping position and the non-clipping position, the receiver 10 can be recharged from a computer system by electrically connecting with the transmitter 30, such that the contact 14 of the receiver 10 touches a contact 31 of the transmitter 30. The positioning protrusion 12 will be engaged with a recess (not shown) of the transmitter 30 so as to achieve a positioning effect.

Prior to assembling the transmitter 30, one can first pivot, by force, the flexible clip 2 in a direction M away from the clipping position. There is no difficulty for such an action due to the flexibility of the flexible clip 2. FIG. 6 clearly shows that the flexible clip 2, under a state of flexibility, moves from a clipping position to a non-clipping position, and that the positioning protrusion 12 presses upon the top of the positioning wall 24.

Although the present invention has been explained in relation to its preferred embodiments, it is to be understood that many other possible modifications and variations can be made without departing from the scope of the invention as hereinafter claimed.

What is claimed is:

1. A clip structure for a wireless transmission device, comprising:

a housing, being provided, on a surface thereof, with a positioning protrusion;

a flexible clip pivotally disposed on the surface of the housing for swinging to at least one lateral side of the housing into a non-clipping position, and including an internal clip surface opposite to the surface of the housing;

a guide ramp, being protruded from the internal clip surface of the flexible clip; and a positioning wall, being protruded from the internal clip surface and disposed between a pivotal location of the flexible clip and the guide ramp, and the guide ramp being sloped down toward a direction away from the positioning wall;

whereby, when the flexible clip is pivoted to a clipping position, the positioning protrusion is located between the guide ramp and the positioning wall, and the positioning wall restrains the positioning protrusion therein and prevents the flexible clip from pivoting and escaping from the clipping position.

2. The clip structure for a wireless transmission device as claimed in claim 1, wherein the positioning wall has a U-shaped configuration.

3. The clip structure for a wireless transmission device as claimed in claim 2, wherein both ends of the positioning wall are formed with oblique surfaces.

4. The clip structure for a wireless transmission device as claimed in claim 1, wherein the housing further includes a fastening concave and the flexible clip further includes a hook, such that the flexible clip fastens to the housing by inserting the hook into and engaging with the fastening concave, and the hook can pivot about the fastening concave.

5. The clip structure for a wireless transmission device as claimed in claim 4, wherein the hook includes two arc resilient arms each of which extends, at top, outwardly and is engaged with the housing.

6. The clip structure for a wireless transmission device as claimed in claim 4, wherein the flexible clip is further provided with a reinforcing rib for pressing on a wall of the fastening concave.

7. The clip structure for a wireless transmission device as claimed in claim 1, wherein the positioning protrusion has an arc tip.

8. The clip structure for a wireless transmission device as claimed in claim 1, wherein a top of the guide ramp is curved.

9. The clip structure for a wireless transmission device as claimed in claim 1, wherein a hole is provided on the internal clip surface of the flexible clip such that a string can pass through the hole.

* * * * *